US008572900B1

(12) United States Patent
Potts

(10) Patent No.: US 8,572,900 B1
(45) Date of Patent: Nov. 5, 2013

(54) DECKING HAVING A REMOVABLE RIB

(75) Inventor: Stephen Michael Potts, Pittsburgh, PA (US)

(73) Assignee: Epic Metals Corporation, Rankin, PA (US)

( * ) Notice: Subject to any disclaimer, the term of this patent is extended or adjusted under 35 U.S.C. 154(b) by 706 days.

(21) Appl. No.: 12/692,182

(22) Filed: Jan. 22, 2010

(51) Int. Cl.

| | |
|---|---|
| ***E02D 29/14*** | (2006.01) |
| ***E04B 7/18*** | (2006.01) |
| ***E04D 13/00*** | (2006.01) |
| ***E04F 19/08*** | (2006.01) |

(52) U.S. Cl.
USPC ..... 52/19; 52/64; 52/745.05; 52/745.15

(58) Field of Classification Search
USPC ..... 52/177, 573.1, 783.14, 19, 79.7, 171.1, 52/64, 71, 72, 73, 745.05, 745.15
See application file for complete search history.

(56) References Cited

U.S. PATENT DOCUMENTS

| | | | |
|---|---|---|---|
| 496,464 | A | 5/1893 | White |
| 571,417 | A | 11/1896 | Turner |
| 799,391 | A | 9/1905 | Lee |
| 901,757 | A | 10/1908 | Utard et al. |
| 1,090,171 | A | 3/1914 | Schisler |
| 2,015,114 | A | 9/1935 | Kellogg |
| 2,031,631 | A | 2/1936 | Bemis |
| 2,105,280 | A | 1/1938 | Bass |
| 2,220,349 | A | 11/1940 | Plumb |
| 2,224,313 | A | 12/1940 | Palmer |
| 2,234,799 | A | 3/1941 | Eason |
| 2,357,560 | A | 9/1944 | Taforo, Jr. |
| 2,397,388 | A | 3/1946 | Troedsson |
| 2,570,313 | A | 10/1951 | Bourgonjon et al. |
| 2,576,530 | A | 11/1951 | Medal |
| 2,750,313 | A | 6/1956 | Schwartz et al. |
| 2,775,324 | A | 12/1956 | Tate |
| 2,873,008 | A | 2/1959 | Ashman |
| 2,992,711 | A | 7/1961 | Mitchell et al. |
| 2,997,141 | A | 8/1961 | Wetzler |
| 3,004,141 | A | 10/1961 | Waller et al. |
| 3,068,535 | A | 12/1962 | Gruber et al. |
| 3,076,390 | A | 2/1963 | Custer |
| 3,089,281 | A | 5/1963 | Borges |
| 3,102,610 | A | 9/1963 | Shelby, Jr. |
| 3,102,611 | A | 9/1963 | Mote |
| 3,162,280 | A | 12/1964 | Hinze |
| 3,169,346 | A | 2/1965 | Sklar |
| 3,190,410 | A | 6/1965 | Molstad |
| 3,192,577 | A * | 7/1965 | Barr ..... 52/364 |

(Continued)

OTHER PUBLICATIONS

Fenestra Incorporated, "floor and roof panel systems," pp. 26-27 (1960).

(Continued)

*Primary Examiner* — Andrew Triggs
(74) *Attorney, Agent, or Firm* — The Webb Law Firm

(57) ABSTRACT

A deck panel assembly that includes a deck panel having an upper surface and a bottom surface and includes a first section, a second section, and an intermediate section defined between the first section and the second section. Each section includes at least one longitudinal extending rib portion. A pair of spaced apart support members connects the first section, the intermediate section, and the second section to each other, wherein the intermediate section is adapted to be removed from between the first section and the second section of said deck panel and from between the spaced apart support members, thereby defining an access port therein.

14 Claims, 13 Drawing Sheets

(56) References Cited

U.S. PATENT DOCUMENTS

| | | | | | |
|---|---|---|---|---|---|
| 3,218,773 | A | | 11/1965 | Heirich | |
| 3,241,280 | A | | 3/1966 | Kreuzer | |
| 3,257,764 | A | | 6/1966 | Cripe | |
| 3,344,563 | A | | 10/1967 | Miles et al. | |
| 3,388,516 | A | | 6/1968 | Thielen | |
| 3,394,514 | A | | 7/1968 | Lindner | |
| 3,411,254 | A | | 11/1968 | Kessler | |
| 3,426,492 | A | | 2/1969 | Fork | |
| 3,469,873 | A | | 9/1969 | Glaros | |
| 3,495,363 | A | | 2/1970 | Johnson | |
| 3,555,756 | A | | 1/1971 | Curran et al. | |
| 3,583,123 | A | | 6/1971 | Holmgren et al. | |
| 3,732,656 | A | | 5/1973 | Robinsky | |
| 3,812,636 | A | | 5/1974 | Albrecht et al. | |
| 3,867,802 | A | | 2/1975 | Murphy | |
| 3,886,702 | A | | 6/1975 | Fork | |
| 3,903,666 | A | | 9/1975 | Fork | |
| 3,925,953 | A | | 12/1975 | LaBorde | |
| 3,948,347 | A | | 4/1976 | Rutledge | |
| 3,959,943 | A | | 6/1976 | Shea et al. | |
| 3,960,625 | A | * | 6/1976 | Simpson | 156/79 |
| 3,967,430 | A | | 7/1976 | Knudson | |
| 4,028,859 | A | | 6/1977 | Bellagamba | |
| 4,051,639 | A | * | 10/1977 | Lombardi et al. | 52/64 |
| 4,057,944 | A | | 11/1977 | Wyatt, Jr. et al. | |
| 4,133,158 | A | | 1/1979 | Ting | |
| 4,186,541 | A | | 2/1980 | Sivachenko | |
| 4,267,679 | A | | 5/1981 | Thompson | |
| 4,272,941 | A | | 6/1981 | Hasselbacher et al. | |
| 4,346,544 | A | | 8/1982 | Larssen | |
| 4,434,592 | A | | 3/1984 | Reneault et al. | |
| 4,453,349 | A | | 6/1984 | Ryan | |
| 4,453,364 | A | | 6/1984 | Ting | |
| 4,558,546 | A | | 12/1985 | Nusbaum | |
| 4,559,749 | A | * | 12/1985 | Nusbaum | 174/482 |
| 4,625,484 | A | | 12/1986 | Oboler | |
| 4,697,399 | A | | 10/1987 | Ryan | |
| 4,825,612 | A | * | 5/1989 | Tupman | 52/371 |
| 4,837,994 | A | | 6/1989 | Stohs | |
| 4,947,595 | A | | 8/1990 | Douds et al. | |
| 4,962,622 | A | | 10/1990 | Albrecht et al. | |
| 4,965,972 | A | | 10/1990 | Domigan et al. | |
| 4,987,717 | A | | 1/1991 | Dameron, Jr. | |
| 5,109,643 | A | | 5/1992 | Speers | |
| 5,134,825 | A | | 8/1992 | Berridge | |
| 5,172,527 | A | | 12/1992 | Ault | |
| 5,205,098 | A | | 4/1993 | Landis et al. | |
| 5,218,794 | A | * | 6/1993 | Ehrlich | 52/64 |
| 5,259,157 | A | | 11/1993 | Ault | |
| 5,355,649 | A | | 10/1994 | Berridge | |
| 5,491,951 | A | | 2/1996 | Riegelman | |
| 5,568,714 | A | | 10/1996 | Peterson | |
| 5,617,695 | A | | 4/1997 | Brimmer | |
| 5,636,481 | A | | 6/1997 | De Zen | |
| 5,720,144 | A | | 2/1998 | Knudson et al. | |
| 5,727,356 | A | | 3/1998 | Ensinger et al. | |
| 5,860,265 | A | | 1/1999 | Knudson et al. | |
| 6,047,510 | A | | 4/2000 | Gallaway | |
| 6,085,485 | A | | 7/2000 | Murdock | |
| 6,094,878 | A | | 8/2000 | Schluter | |
| 6,141,932 | A | * | 11/2000 | Tarrant | 52/514 |
| 6,233,892 | B1 | | 5/2001 | Tylman | |
| 6,357,191 | B1 | | 3/2002 | Ault et al. | |
| 6,631,599 | B1 | * | 10/2003 | Takagi | 52/579 |
| 6,639,482 | B2 | | 10/2003 | Geiger et al. | |
| 6,649,006 | B2 | | 11/2003 | Benson et al. | |
| 6,691,482 | B1 | | 2/2004 | Ault | |
| 6,813,864 | B2 | | 11/2004 | Landis | |
| 6,910,311 | B2 | | 6/2005 | Lindberg et al. | |
| 6,959,519 | B2 | | 11/2005 | Adriaansen | |
| 6,962,025 | B1 | | 11/2005 | Hill | |
| 7,051,489 | B1 | | 5/2006 | Swiszcz et al. | |
| 7,146,920 | B1 | | 12/2006 | Ryan et al. | |
| 7,328,667 | B1 | | 2/2008 | Ryan et al. | |
| 7,418,807 | B1 | | 9/2008 | Ryan et al. | |
| 7,493,729 | B1 | | 2/2009 | Semmes | |
| 7,493,738 | B2 | | 2/2009 | Bui | |
| 7,497,056 | B2 | | 3/2009 | Surowiecki | |
| 2002/0124484 | A1 | | 9/2002 | Martin | |
| 2003/0110730 | A1 | | 6/2003 | Vos | |
| 2003/0182889 | A1 | | 10/2003 | Takagi | |
| 2005/0120663 | A1 | | 6/2005 | Pegoraro | |
| 2005/0178076 | A1 | | 8/2005 | Rasmussen et al. | |
| 2009/0000246 | A1 | | 1/2009 | Chang | |

OTHER PUBLICATIONS

Epic Metals Corporation, "Wideck Access Panels," single page flyer (2003).

Epic Metals Corporation, "Epicore 3.5 Roof and Floor Deck Ceiling Systems," brochure (2006).

* cited by examiner

DECKING HAVING A REMOVABLE RIB

BACKGROUND OF THE INVENTION

1. Field of the Invention

This invention relates to a deck panel and, more particularly, to a deck panel having a removable rib portion.

2. Description of Related Art

The construction of convention centers, arenas, office buildings, and other major structures normally uses deck panels assembled in a side-by-side and/or end-to-end relationship to facilitate the construction of a structural deck. FIGS. 1A-1C show a typical prior art deck panel 10 with a dove-tail shaped profile that includes a body 12 having a first end 14, a second end 16, an upper surface 18, and a bottom surface 20 and defining a plurality of longitudinal extending rib portions 22. Each rib portion 22 includes a section of two spaced apart ribs 24 on the upper surface 18 thereof and defining a first recess 26 therebetween. A second recess 28 is defined on the bottom surface 20 of each rib 24. The deck panel 10 may have any other profiles such as a keystone profile. Typically, as shown in FIG. 7, adjacent panels 10', 10", and 10'" all of which correspond to deck panel 10 are joined together by lap joints L as shown, although other connecting arrangement lap joints can be used. In general, the upper surface 18 of the deck panel body 12 provides the floor or roof support and the bottom surface 20 provides the ceiling or the ceiling support. Typically, a plurality of these panels are connected together to form the structural deck supported by support structure B, which can be a purlin, beam, truss, or any supporting member or supporting wall, for example, extending traversely across each end of the panels as shown in FIGS. 1B and 1C. See, for example, U.S. Pat. Nos. 5,172,527, 6,357,191, 6,691,482, and 7,328,667. An access port is usually needed to access the electrical cables or other materials contained within areas positioned above the deck panel. Heretofore, access was provided through side entry of the panel through an opening or by cutting an unsightly hole or access port C as shown in FIG. 1A in the panel from underneath the panel or providing a removable panel such as the Epic WIDECK® Access Panels.

Therefore, it is desirable to have an access port that does not disrupt the strength of the deck panel structure. It is further desirable that the access port be large enough to effectively access all materials above the deck panel necessary to complete repairs. It is also desirable that the access port be easily removable and does not adversely affect the ornamental appearance of the deck panels.

SUMMARY OF THE INVENTION

The present invention provides for a deck panel assembly that includes a deck panel having an upper surface and a bottom surface and includes a first rib section, a second rib section, and an intermediate rib section defined between the first section and the second section. Each rib section includes at least one longitudinal extending rib portion. A pair of spaced apart support members connects the first section, the intermediate section, and the second section to each other, wherein the intermediate section is adapted to be removed from between the first section and the second section of the deck panel and from between the spaced apart support members, thereby defining an access port therein.

DETAILED DESCRIPTION OF THE INVENTION

Figure 1A:
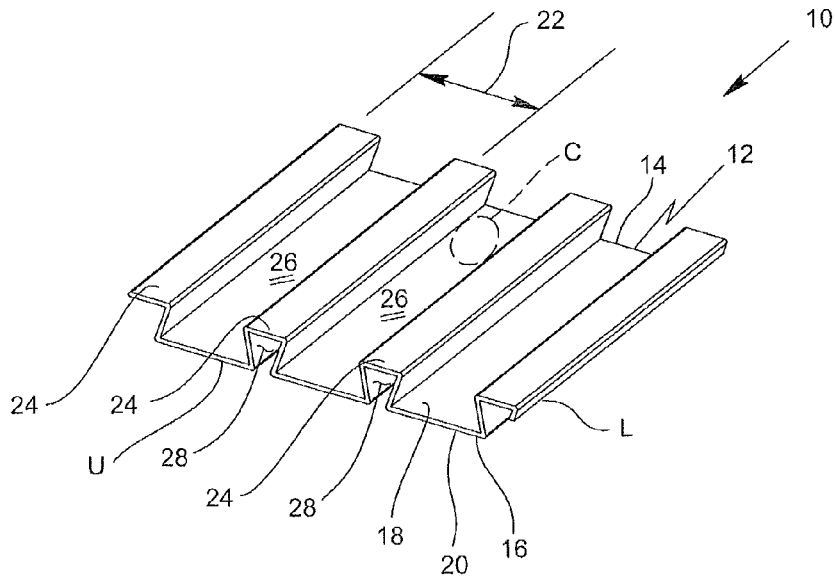
PRIOR ART FIG. 1A
FIG. 1A is a top perspective view of a portion of a prior art deck panel.
Figure 1B:
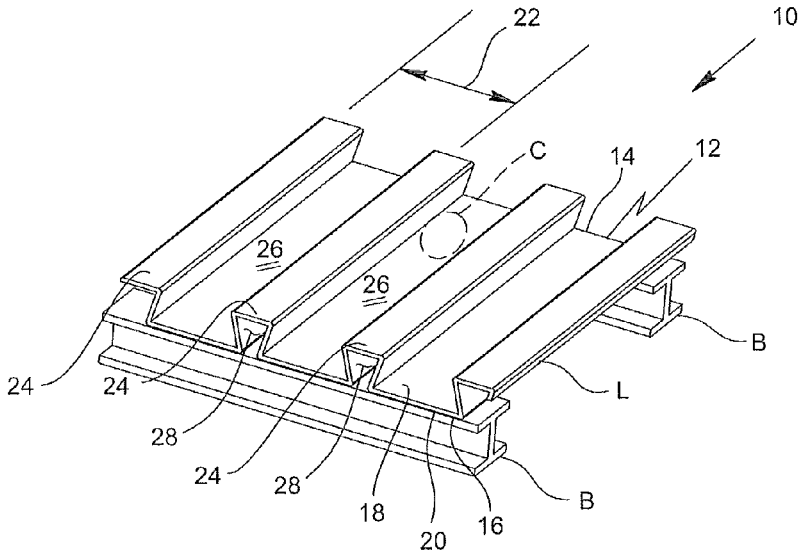
PRIOR ART FIG. 1B
FIG. 1B is a top perspective view of the prior art deck panel shown in FIG. 1A with support beams underneath.
Figure 1C:
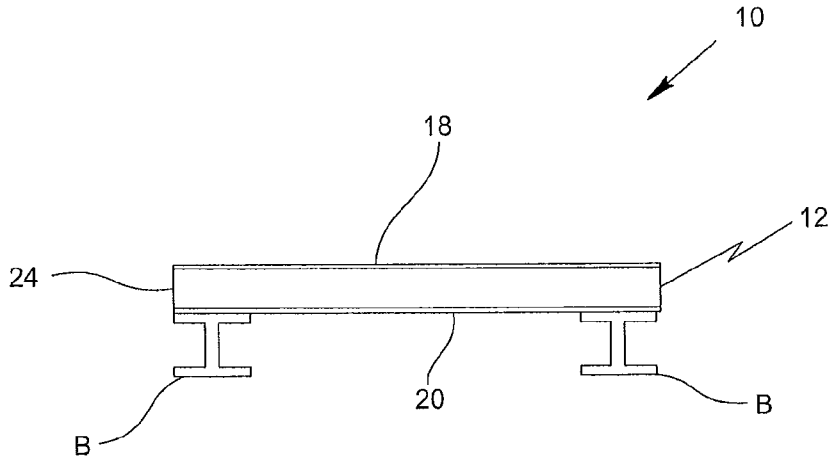
FIG. 1C PRIOR ART
FIG. 1C is a side elevational view of the prior art deck panel shown in FIG. 1B.

Referring to FIGS. 2A-2C, 3A, and 3B, the present invention provides for a deck panel assembly 30 that includes a deck panel 32 similar to the prior art deck panel 10 except for the differences noted below. Like reference numerals are used for like parts. The deck panel 32 includes a body 34 having a first end 14, a second end 16, an upper surface 18, and a bottom surface 20. The body 34 also includes a first rib section 36, a second rib section 38, and an intermediate rib section 40 defined between the first section 36 and the second section 38. Each rib section 36, 38, and 40 of the deck panel 32 has a longitudinal extending rib portion 22 that includes two spaced apart ribs 24, wherein each rib 24 includes a pair of spaced apart side walls 25A and a top wall 25B connecting the side walls 25A to each other. A first recess 26 is defined on the upper surface 18 between the spaced apart ribs 24 and a second recess 28 is defined on the bottom surface 20 of each rib 24. The length and width of the deck panel 32 may vary depending upon the size of the ceiling or roof structure. Further, the number of rib sections may vary per panel assembly 30. However, typically the panel assembly 30 includes three rib sections or more. The deck panel 32 may be made of metal and/or a rigid polymeric material known in the art.

In general, a typical deck panel is usually a unitary piece of material having a plurality of longitudinal extending rib portions 22 therein, as shown in FIG. 1A of the prior art. The deck panel is generally supported at the first end 14 and the second end 16 by a support structure B, such as a wall, I-beam, or purlin. In the prior art, an opening or access port would have to be formed in the rib portion 22 of the deck panel 10 in order to access the areas positioned thereabove. For example, as shown in FIG. 1A in phantom, an access port C formed in the rib portion 22 adversely affects the appearance of the deck panel 10 and weakens its strength.

Figure 2A:
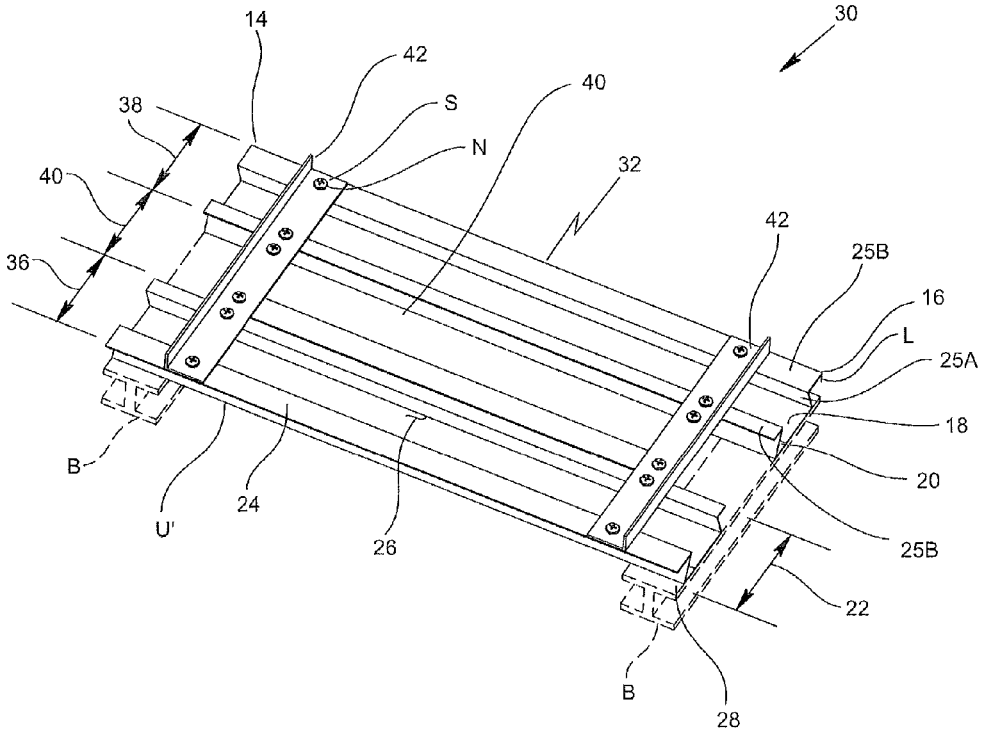
FIG. 2A is a top perspective view of a deck panel assembly according to the present invention.
Figure 2B:
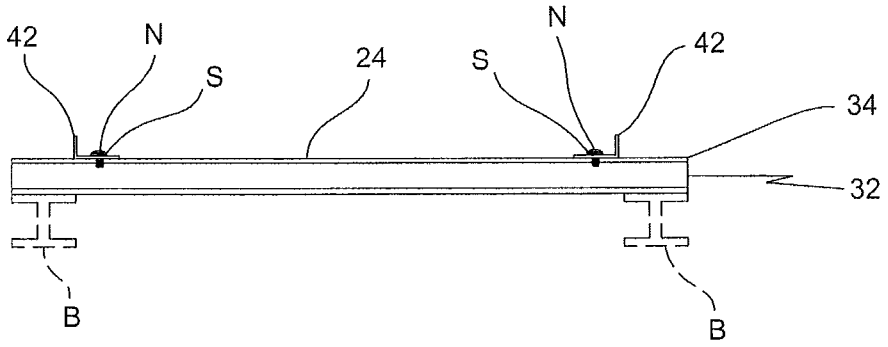
FIG. 2B is a side elevational view of the deck panel assembly shown in FIG. 2A.
Figure 3A:
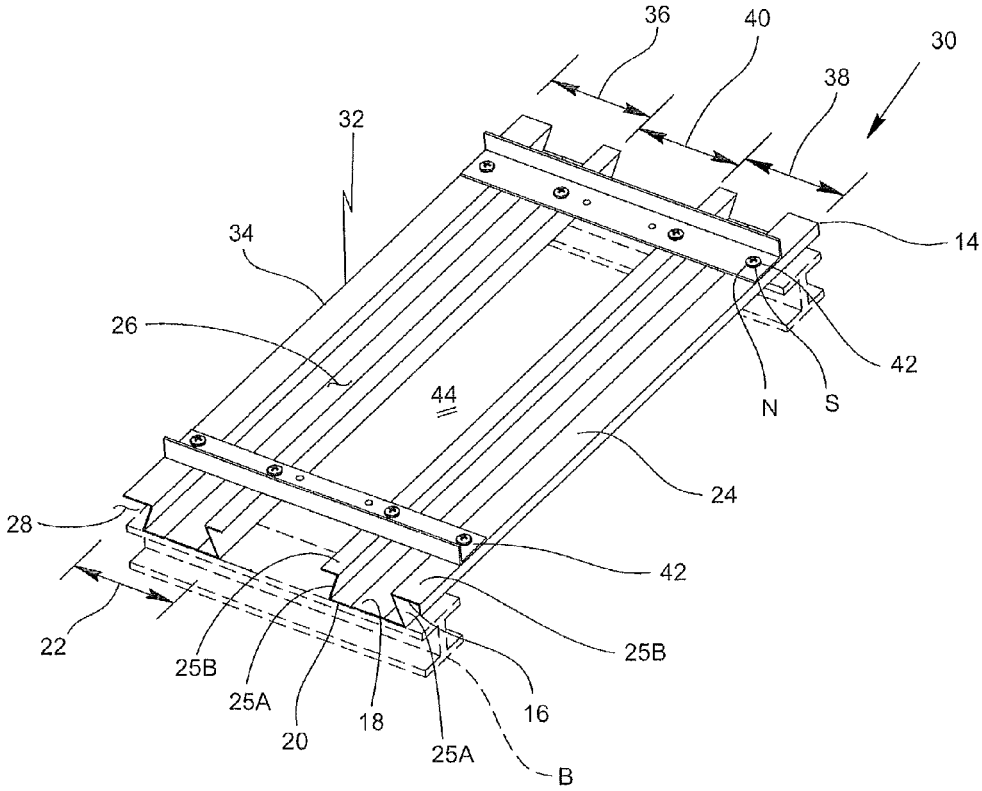
FIG. 3A is a top perspective view of a deck panel assembly shown in FIG. 2A having a rib portion removed therefrom.
Figure 3B:
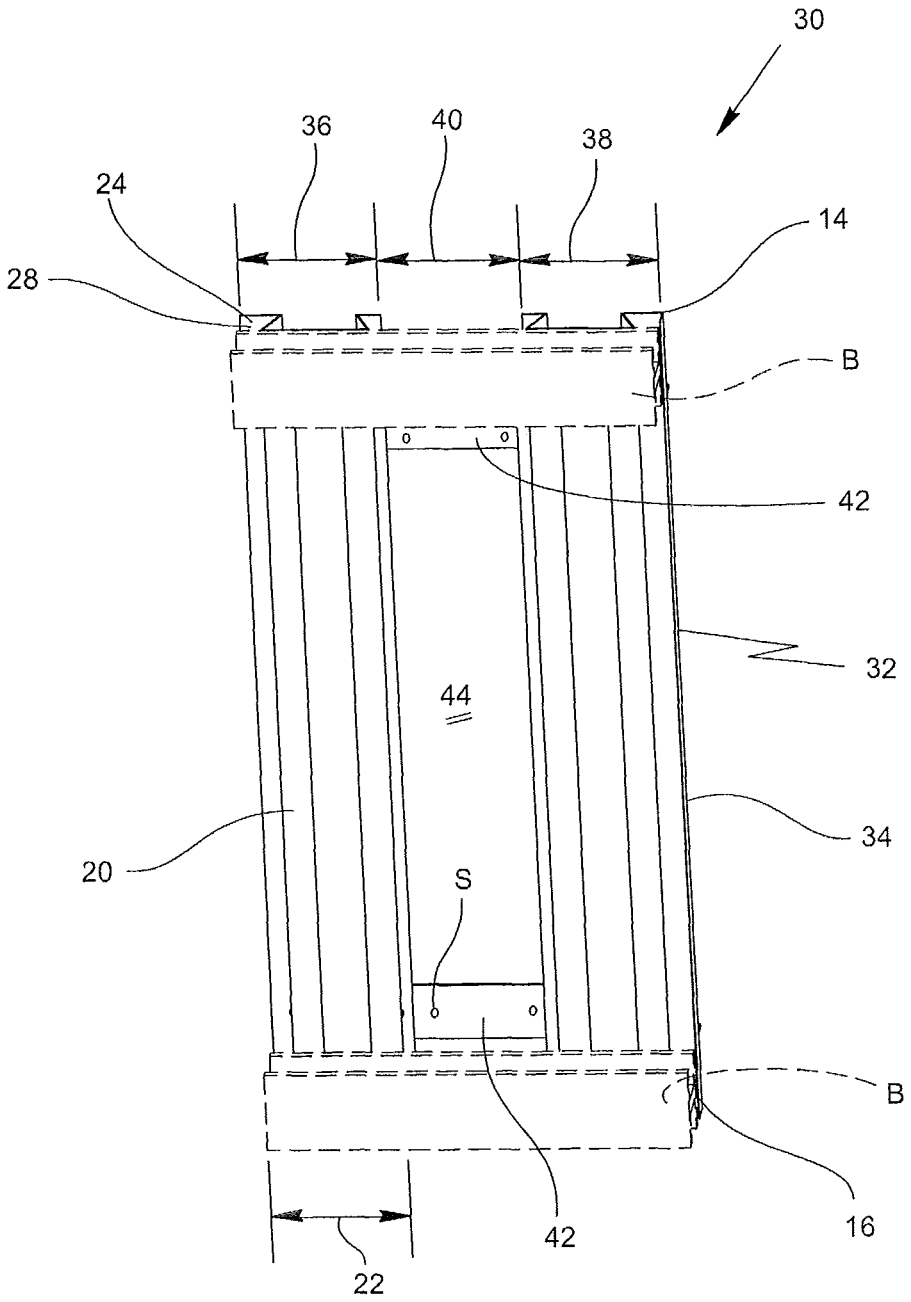
FIG. 3B is a bottom elevational view of the deck panel assembly shown in FIG. 3A.

In the present invention, this prior art unitary deck panel is divided into three separate rib sections (i.e., 36, 38, and 40), wherein a pair of spaced apart L-shaped support members 42 connects the first rib section 36, the intermediate rib section 40, and the second rib section 38 to each other, as shown in FIG. 2A. Referring to FIGS. 2A and 3A, each rib section 36, 38, and 40 includes a lengthwise portion of the top wall 25B of each of the two spaced apart ribs 24 of the respective rib portion 22. The intermediate section 40 of the deck panel assembly 30 is removable from between the first section 36 and the second section 38 of the deck panel 32, thereby defining an access port 44 therein, as shown in FIG. 3A. The ends 14 and 16 of the non-removable rib sections 36 and 38 extend beyond the ends of the removable intermediate section 40 of the deck panel assembly 30.

Figure 2C:
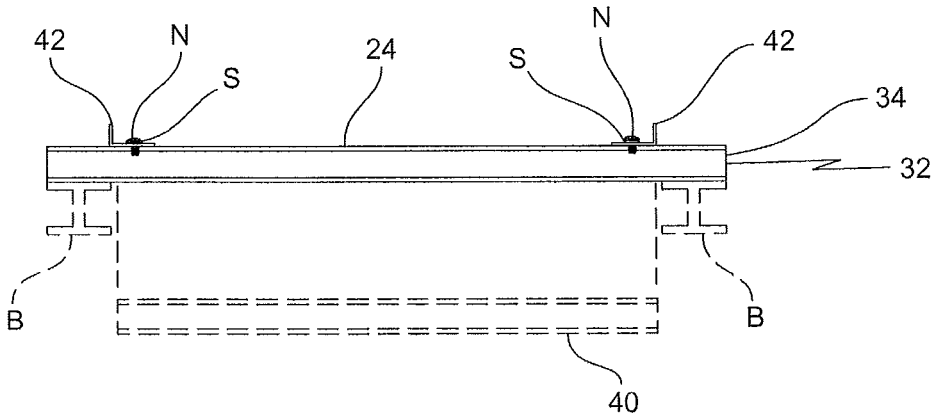
FIG. 2C is a side elevational view of the deck panel assembly of FIG. 2B showing a rib portion being removed therefrom.
Figure 4:
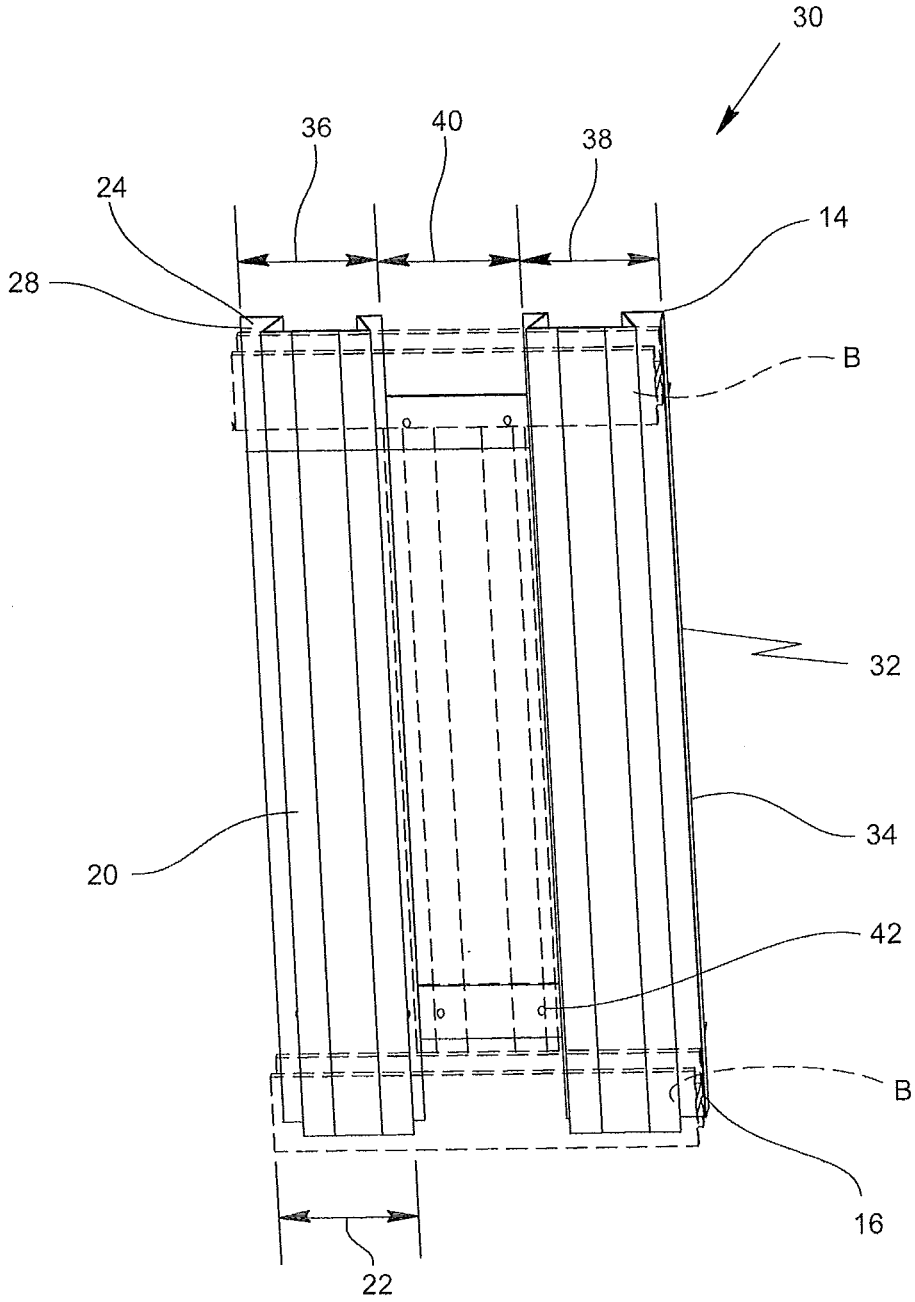
FIG. 4 is a bottom elevational view of the deck panel shown in FIG. 3B having a rib portion installed therein.

With continued reference to FIGS. 2A and 3A, the support members 42 are positioned traversely across a width of the upper surface 18 of at least one rib portion 22 of each rib section 36, 38, and 40 of the deck panel body 34 and releasably attached thereto. The first end 14 and the second end 16 of rib sections 36 and 38 of the deck panel 32 are supported on the support beams B (shown in phantom), whereas the ends of the intermediate section 40 extend to the interior edge of the support beams B, thereby enabling removal of the intermediate section 40. Further, the intermediate section 40 can be positioned in between ends 12 and 14 but does not have to extend to the complete width so that a non-removable section is also provided. FIG. 2C shows the intermediate rib section 40 being removed from the deck panel without any interference from the support beam B. FIG. 4 shows a bottom surface 20 of the deck panel 32, wherein each rib section 36, 38, and 40 (the intermediate section 40 shown in phantom) appears as one uniform deck panel.

FIG. 3A shows the support member 42 as an L-shaped channel having slots S therein attached to the rib sections 36, 38, and 40, as shown in FIG. 2A. However, the support member 42 can take on any other shape as long as the support member 42 connects each of the sections 36, 38, and 40 to each other. Attachment of the support member 42 to the deck panel 32 may be achieved by passing a nut and bolt arrangement N through the slots S in the support member 42 and through the top wall 25B on the upper surface 18 of each rib 24 of the rib portion 22 of each rib section 36, 38, and 40. The length of the support member 42 is such that the support member 42 is mechanically fastened to the intermediate section 40 and to at least one longitudinal extending rib portion 22 of the first section 36 and the second section 38 of the body 34 of the deck panel 32. Also, the support member 42 may be permanently attached, such as welded, to the first section 36 and the second section 38 and releasably attached to the intermediate section 40 of the deck panel 32. Removal of the intermediate section 40 from the deck panel 32 is achieved by unbolting the nut and bolt arrangement N from the support member 42 in the intermediate section 40 of the deck panel assembly 30. Any loads applied to intermediate section 40 are transferred to support members 42 and in turn to sections 36 and 38 so that the deck panel assembly 30 has at least the same or similar strength and load carrying capabilities as the prior art deck panel 10, as well as the similar appearance from the under side U' of the deck panel assembly 30 as the under side U of the deck panel 10 when the section 40 is installed on the deck panel assembly 30.

Figure 5:
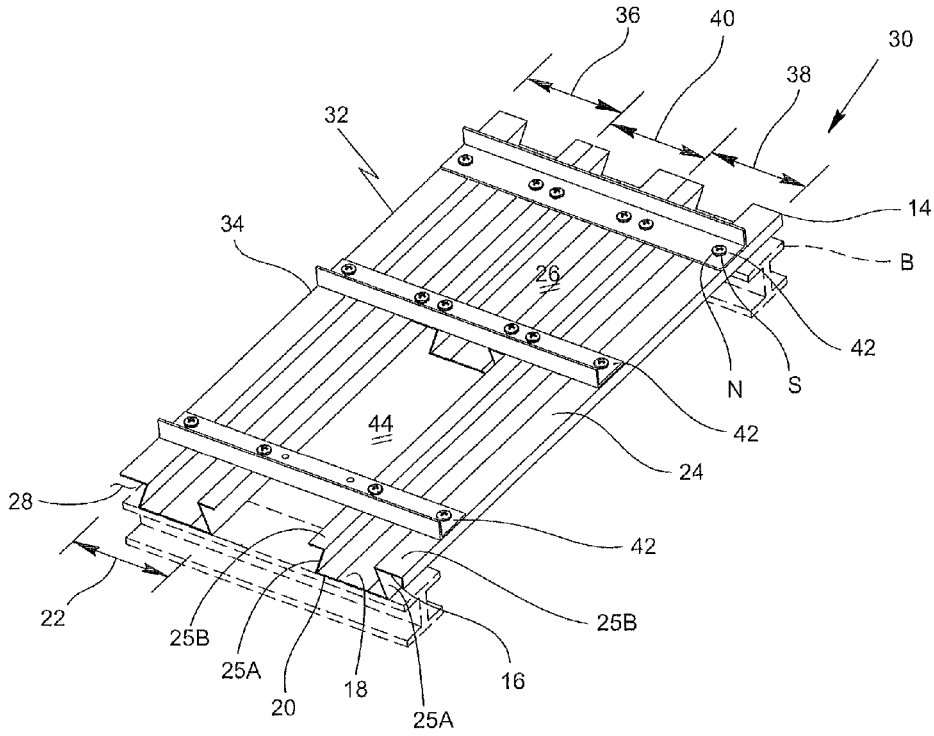
FIG. 5 is a perspective view of a third embodiment of a deck panel assembly according to the present invention having a section of a rib portion removed therefrom.
Figure 6:
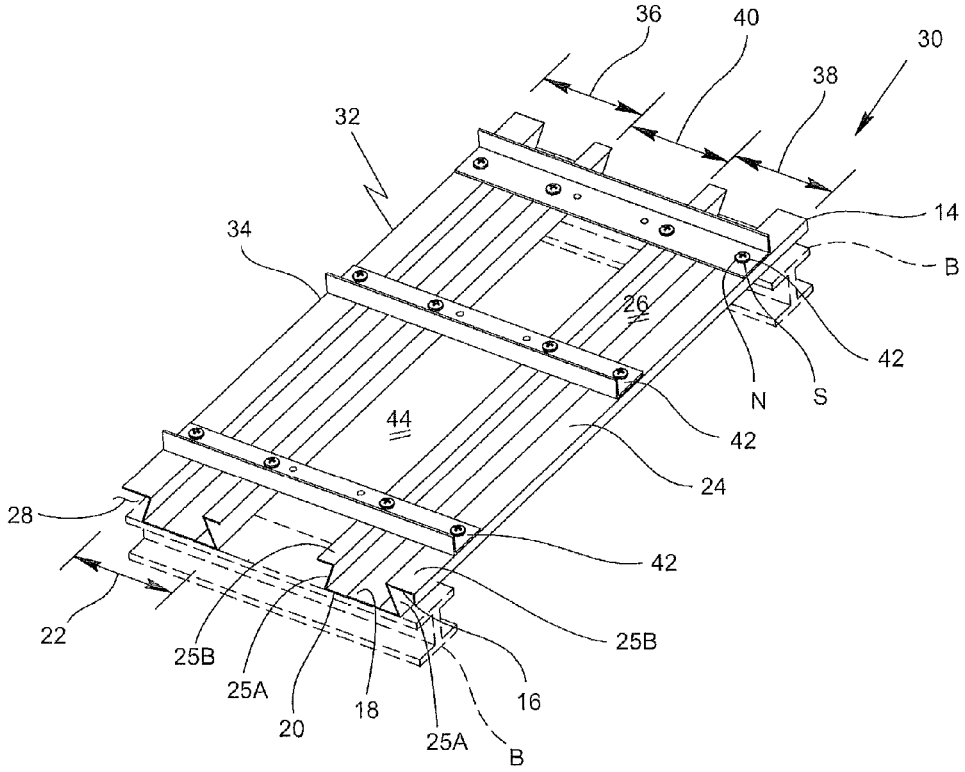
FIG. 6 is a perspective view of the deck panel assembly shown in FIG. 5 having the entire rib portion removed therefrom.
Figure 7:
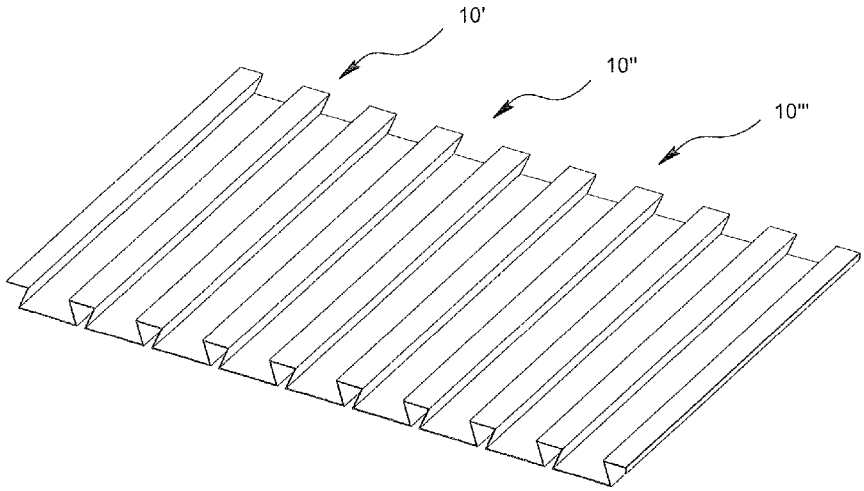
PRIOR ART FIG. 7
FIG. 7 is a top perspective view of a prior art deck panel assembly made from a plurality of deck panels shown in FIG. 1.

Referring to FIGS. 5 and 6, the deck panel assembly 30 may have a plurality of spaced apart support members 42, whereby a portion of the intermediate section 40 between two adjacent support members 42 is removable. This may be achieved by removing the rib portion 22 of the intermediate section 40 traversely along a width of two adjacent support members 42, such that only a portion of the intermediate section 40 is removed. With this arrangement, the intermediate section 40 of deck panel assembly 30 may have multiple access ports 44 defined therein. FIG. 6 shows the entire intermediate section 40 removed from the deck panel assembly 30, thereby providing an access port 44 that extends from the first end 14 to the second end 16 of the deck panel 32. It is envisioned that the deck panel 32 may have more than three rib sections, such that the intermediate section 40 may include a plurality of longitudinal rib portions 22, thereby providing a wider access port 44 (from the removal of multiple rib portions 22) within the deck panel assembly 30. It is also envisioned that a roof structure may have a plurality of deck panel assemblies 30 having multiple intermediate sections 40 within the structure.

Figure 8:
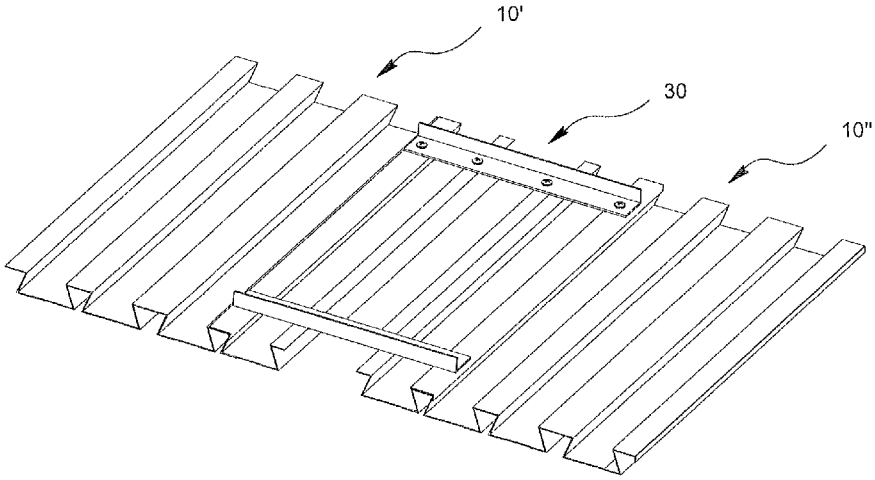
FIG. 8 is a top perspective view of a deck structure made in accordance with the present invention.
Figure 9:
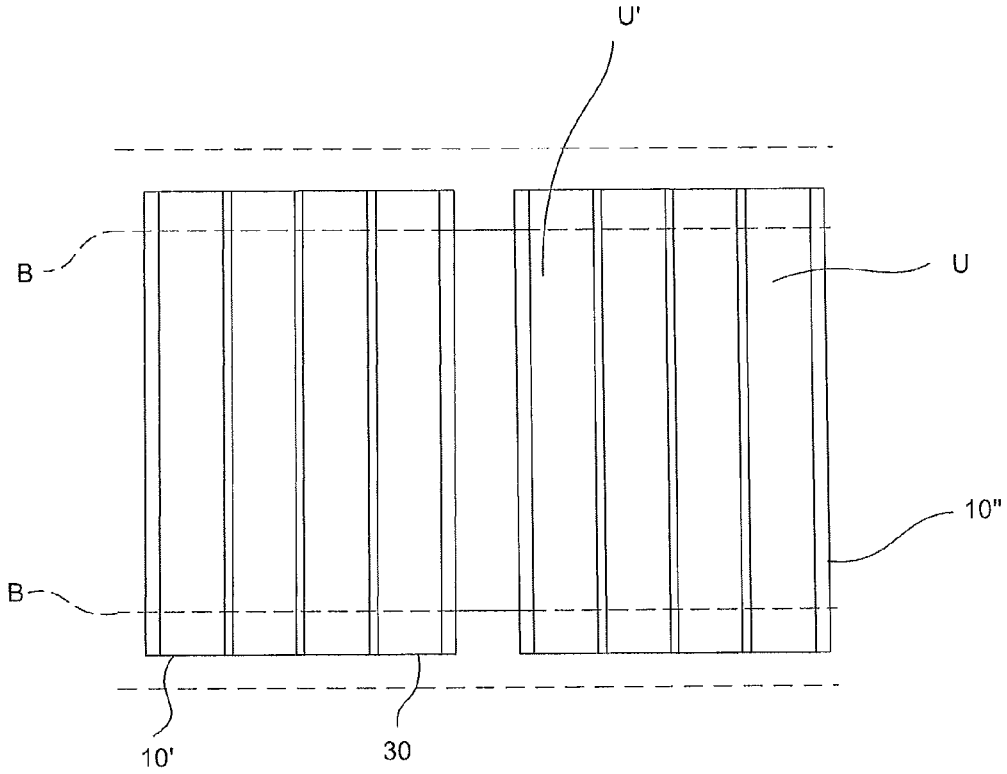
FIG. 9 is a bottom plan view of the deck structure made in accordance with the present invention.

The present deck panel assembly 30 then may be attached to adjacent prior art deck panels 10 with the lap joints to form a deck structure such as a roof deck or ceiling. As shown in FIGS. 8 and 9, this results in a structural load bearing deck that has a pleasant architectural appearance from the underside of the deck, without the ugly appearance of a prior art access panel, since the present intermediate section 40 blends with the decking when the intermediate section 40 is in place, as shown in FIG. 9. Referring to FIGS. 2A-2C and 3A-3B, the present invention provides for a method of accessing materials on an upper surface 18 of a deck panel 32 from underneath a ceiling support. The method includes the steps of providing a deck panel assembly 30, as previously described, and removing the intermediate section 40 from between the first section 36 and the second section 38 of the deck panel 32 and from between the spaced apart support members 42, thereby defining an access port 44 therein. Next, the materials positioned above the deck panel assembly 30 adjacent the upper surface 18 are accessed through the access port 44, whereby repairs, maintenance, installations, and the like may be accomplished.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A deck panel assembly comprising:

a deck panel having an upper surface and a bottom surface that includes a first section, a second section, and an intermediate section defined between said first section and said second section, each section includes at least one longitudinal extending rib portion; and at least two spaced apart support members connecting said first section, said intermediate section, and said second section to each other, wherein said intermediate section is adapted to be removed from between said first section and said second section of said deck panel and from between said spaced apart support members, thereby defining an access port therein, wherein the access port extends through the deck panel, and wherein the at least two spaced apart support members are disposed above the deck panel and the intermediate section is adapted to be removed from below the deck panel.

2. The deck panel assembly of claim 1, wherein the deck panel includes a body having a first end and a second end and, wherein a portion of said intermediate section between said first end and said second end of said deck panel is removable.

3. The deck panel assembly of claim 1, wherein the deck panel includes a body having a first end and a second end and, wherein said entire intermediate section between said spaced apart support members of said deck panel is removable.

4. The deck panel assembly of claim 1, wherein the at least two spaced apart support members comprise at least three spaced apart support members releasably attached to said upper surface of said first section, said intermediate section, and said second section of said deck panel, and wherein portions of said intermediate section between two adjacent support members are removable, thereby defining a plurality of access ports.

5. The deck panel assembly of claim 1, wherein said support members are releasably attached to said deck panel via mechanical fasteners.

6. The deck panel assembly of claim 1, wherein said support members are attached to said first section and said second section of said deck panel via welding or mechanical fastening.

7. The deck panel assembly of claim 1, wherein said support members are attached transversely across a width of at least one longitudinal extending rib portion of said first section and said second section of said deck panel.

8. The deck panel assembly of claim 1, wherein said support members comprise a transversely extending L-shaped member bolted across a width of said first section, said second section, and said intermediate section of said deck panel.

9. The deck panel assembly of claim 1, wherein the support members transfer loads from the intermediate section to said first section and said second section.

10. A deck panel assembly as claimed in claim 1, further comprising one or more deck panels made of one or more extending ribs co-acting with said first section or said second section.

11. A deck panel assembly comprising:

a deck panel having an upper surface and a bottom surface that includes a first section, a second section, and an intermediate section defined between said first section and said second section, each section includes at least one longitudinal extending rib portion; and a plurality of spaced apart support members connecting said first section, said intermediate section, and said second section to each other, wherein portions of said intermediate section between said first section and said second section of said deck panel and between two adjacent support members are removable, thereby defining a plurality of access ports, wherein the access ports extend through the deck panel, and wherein the plurality of spaced apart support members are disposed above the deck panel and the intermediate section is adapted to be removed from below the deck panel.

12. A method of accessing an access area positioned adjacent to an upper surface of a deck panel from underneath a ceiling support, the method comprising the steps of:

(a) providing a deck panel having an upper surface and a bottom surface that includes a first section, a second section, and an intermediate section defined between said first section and said second section, each section includes at least one longitudinal extending rib portion; and at least two spaced apart support members disposed above the deck panel and connecting said first section, said intermediate section, and said second section to each other, wherein said intermediate section is adapted to be removed from between said first section and said second section of said deck panel and from between the spaced apart support members and from below the deck panel;

(b) removing said intermediate section from between said first section and said second section of said deck panel, thereby defining an access port therein, the access port extending through the deck panel; and (c) accessing the access area adjacent to the upper surface of said deck panel through the access port.

13. The method as claimed in claim 12, wherein the at least two spaced apart support members comprise at least three spaced apart support members, wherein portions of said intermediate section between two adjacent support members are removed, thereby defining a plurality of access ports.

14. The method as claimed in claim 12, comprising the step of replacing the removed intermediate section.

* * * * *